United States Patent [19]

Mauch

[11] 3,977,652

[45] Aug. 31, 1976

[54] WINCH

[76] Inventor: Floyd Mauch, 8245 Kirkwood Drive, Los Angeles, Calif. 90046

[22] Filed: June 5, 1975

[21] Appl. No.: 583,869

[52] U.S. Cl. ..... 254/164; 188/82.6

[51] Int. Cl.[2] ..... A63B 61/04

[58] Field of Search ..... 254/157, 164, 163, 161, 254/186 HC; 188/82.6, 166, 188; 105/368 T, 366 E; 24/68 CD, 68 CT; 192/41 S

[56] References Cited

UNITED STATES PATENTS

| | | | |
|---|---|---|---|
| 2,784,810 | 3/1957 | Ulmann | 188/82.6 |
| 3,542,160 | 11/1970 | Sacchini | 188/82.6 |
| 3,837,441 | 9/1974 | Uno et al. | 188/82.6 |

*Primary Examiner*—Robert J. Spar
*Assistant Examiner*—Kenneth Noland

[57] ABSTRACT

A spring braking structure for a winch comprises a tubular winch drum having a cylindrical member rotatably mounted therein. A helical spring on an end portion of the cylindrical member has its ends respectively coupled to rotate with the winch drum and the cylindrical member. A support including a brake cylinder is provided for supporting the winch drum with the helical spring inserted in the brake cylinder whose inner diameter is smaller than the outer diameter of the helical spring. The resulting bearing friction of the spring on the inner wall of the brake cylinder locks the winch drum against rotating on the support in one direction only. A rod passes through transverse openings provided on the ends of the rubular winch drum and cylinder member. A turning action in either angular direction on the rod causes the spring to wind up to unlock the winch drum thereby enabling the winch drum to rotate to either take up or pay out a cable wound thereon.

5 Claims, 9 Drawing Figures

WINCH

This invention relates to brakes for rotatable devices and more particularly to a winch having an improved spring braking structure and control therefor.

When a load on the end of the cable is taken up by a winch, a ratchet wheel and pawl are commonly provided for the purposes of holding the load as the operator applies a turning action to the handle of the winch. The problem with a winch provided with a ratchet wheel and pawl is that when the cable is to be paid out it is necessary for the operator to disengage the pawl as he controls the turning of the handle of the winch to unwind the cable. Thus the pay out of the cable requires that the operator use both hands, one to manipulate the pawl and the other to control the turning of the handle of the winch. Furthermore, when a winch is provided with a ratchet wheel and pawl, a small reverse movement of the ratchet wheel, and therefore some take up of the cable, is necessary before the cable can be paid out. Moreover, the amount of the pay out or take up of the cable is necessarily incremental, i.e., dependent upon the spacing of the teeth on the ratchet wheel.

Accordingly, one of the objects of the present invention is to provide an improved spring braking structure for a winch which operates to automatically apply a braking action of the winch drum except when a turning action is being applied to the handle of the winch either for the taking up or for the paying out of the cable.

Another object of the present invention is to provide an improved spring braking structure for a winch which can be simply operated by applying a turning action in either angular sense to the handle of a winch by the use of one hand or by use of a motor to either take up or pay out a cable having a load on the end thereof.

Another object of the invention is to provide an improved spring braking structure for a winch that does not require any take up of the cable in order to pay out the cable.

Still another object of the invention is to provide an improved spring braking structure for a winch that is infinitely adjustable as to its effectiveness to thereby permit the take up of any small amount of slack in the cable.

It is a further object of the invention to provide a winch with a simply constructed, reliably operating, spring braking structure that can be economically manufactured for sale at a reasonable price.

With these and other objects in view, the invention consists in the construction, arrangement and combination of the various parts of the device whereby the objects contemplated are obtained as hereinafter set forth, pointed out in the appended claims and illustrated in the accompanying drawings.

Figure 4:
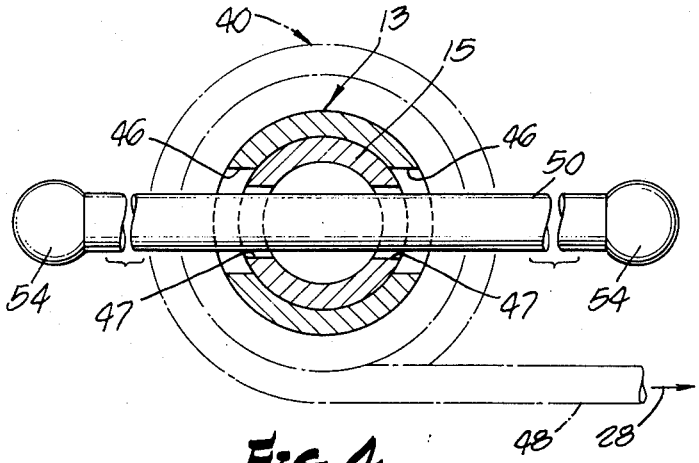
FIG. 4 is a cross-sectional view as taken along line 4—4 in FIG. 1 showing the relation of the winch drum and its inner cylindrical member when the handle of the winch is freely held in transverse holes provided on the ends thereof and the winch is in its brake position.
Figure 5:
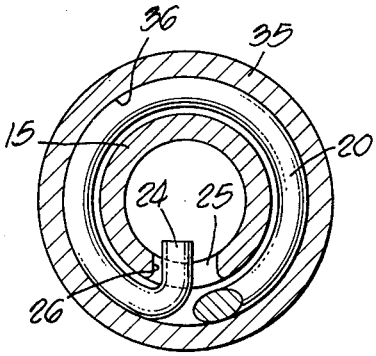
FIG. 5 is a cross-sectional view taken along line 5—5 in FIG. 1 showing the position of the lower end of the spring within the oversized opening on the lower end of the cylindrical member when the winch is in its braking position.
Figure 8:
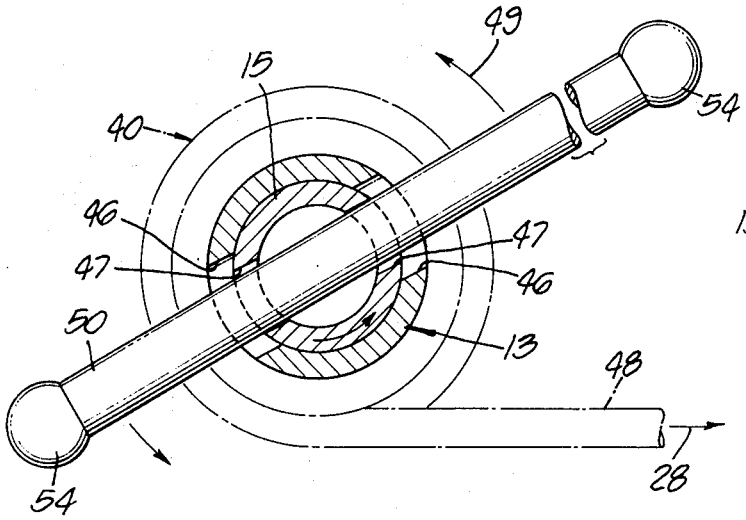
Figure 9:
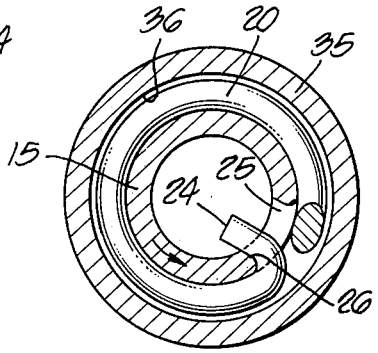

FIG. 8 is a cross-sectional view similar to FIG. 4 showing the rod being provided with a turning action in a counterclockwise direction which enables the winch drum to be rotated to pay out the cable; and FIG. 9 is a cross-sectional view similar to FIG. 5 showing the action of the cylindrical member on the lower end of the spring when the winch drum is being rotated as shown in FIG. 8 to pay out the cable.

Figure 1:
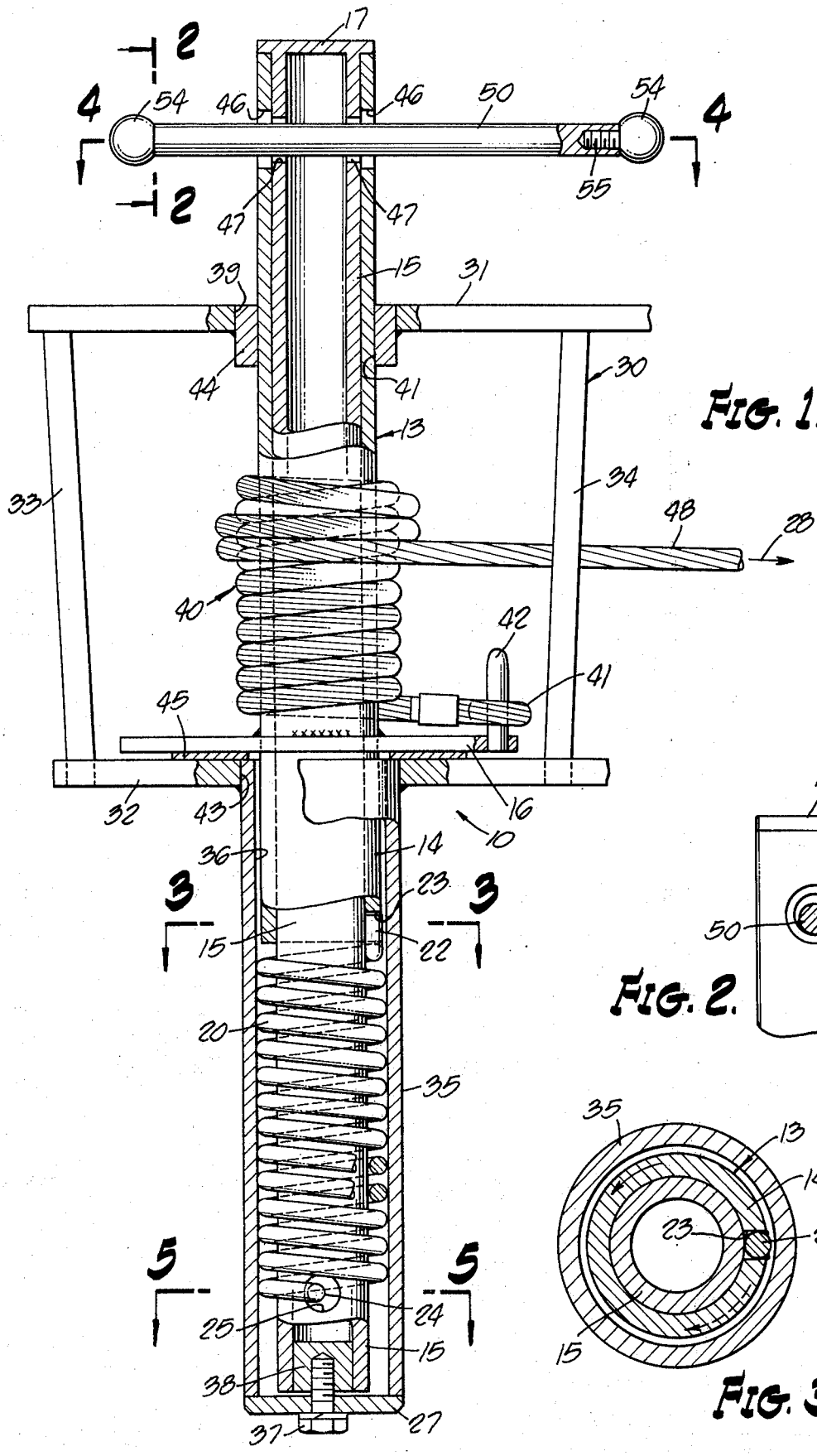
FIG. 1 illustrates the winch of the present invention mounted on a support with parts thereof partly in section.
Figure 2:
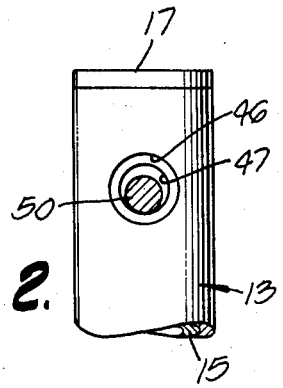
FIG. 2 is a cross-sectional view as taken along line 2—2 of FIG. 1.
Figure 3:
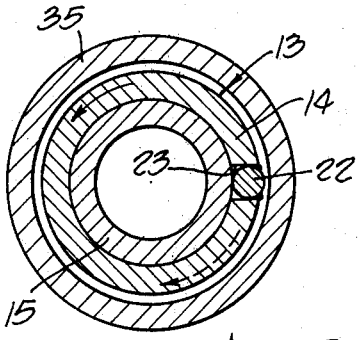
FIG. 3 is a cross-sectional view as taken along line 3—3 of FIG. 1 showing the upper end of the helical spring anchored to the winch drum.

Referring to the drawings, FIG. 1 shows a winch 10 embodying the spring brake structure of the present invention. The winch includes a winch drum 13 in the form of an outer tubular member. Fixed on the lower end portion 14 of the winch drum is a circular stop plate 16. A cylindrical member 15 is disposed to have a rotatable fit within the winch drum 13. The upper end of cylindrical member 15 is provided with a head 17 which bears on the upper end of the winch drum 13 and the lower portion of cylindrical member 15 extends out well beyond the lower end of the winch drum 13. Freely positioned about the lower portion of the inner cylindrical member 15 is a helical spring 20. The upper end 22 of helical spring 20 is bent upwardly so as to be securely fixed by welding, for example, in a slot 23 provided in the wall of the winch drum 13. The lower end 24 of the helical spring 20 is bent inwardly so as to extend into and be freely held in a oversized radial opening 25 provided near the end of the cylindrical member 15. As indicated in FIG. 5, the diameter of the oversized opening 25 is at least twice the diameter of the lower end 24 of the spring 20.

A support for the winch of the invention as shown in FIG. 1 comprises spaced upper and lower walls 31 and 32, respectively, and spaced left and right side walls 33 and 34, respectively. A brake cylinder 35 has its end securely fixed in an opening 43 on the lower wall 32. A bearing member 44 is secured in an opening 39 in the upper wall 31 and is axially aligned with the fixed brake cylinder 35. The assembly comprising the winch drum 13 and its inner cylindrical member 15 having the helical spring 20 on the lower portion thereof is journaled to rotate in the bearing member 44 and the brake cylinder 35 with the helical spring 20 inserted in the brake cylinder 35. When so mounted, the stop plate 16 on the winch drum 13 bears against a flat circular bearing pad 45 secured to the lower wall 32. The cylindrical member 15 has an inner plug 38 fixed on its lower end. A screw 37 passing through a washer 27 and bearing against the lower end of the brake cylinder 35 engages end plug 38 and draws down on the member 15 to hold the winch drum 13 on the support 30.

As indicated in FIG. 1, the inner end of a cable 40 forms a loop 41 which is held on a pin 42 projecting from the face of stop plate 16. After forming several turns about the winch drum 13, the free end 48 of the cable 40 is attached to a load indicated by arrow 28.

It should be noted that the coils of the helical spring 20 on the lower end portion of the cylindrical member 15 have an outer diameter which is normally larger than the inner diameter of the brake cylinder 35. Thus in order to insert the lower end portion of cylindrical member 15 having the helical spring thereon into the braking cylinder 35, at the time the winch is mounted on support 30, it is necessary to first rotate the inner cylindrical member 15 relative to the winch drum 13 so as to contract the spring 20. Then when the cylindrical member 15 is released, the spring 20 by its own torsional force expands or unwinds within the brake cylinder 35 so as to create a small bearing friction against the inner wall 36 of the brake cylinder 35 which locks the winch drum 13 against rotation on its journals on support 30 such as to hold the cable. Winch 10 is now in its brake position.

It should now be clear that the direction in which the helical spring 20 is wound is such that when the winch drum is in its braking position a pull on cable 40 due to the load indicated by the arrow 28 tends to cause the spring 20 to unwind, i.e., expand, thus providing an infinitely greater braking action.

The upper ends of the winch drum 13 and the cylindrical member 15 disposed therein are respectfully provided with longitudinally aligned transverse openings 46 and 47 therethrough for receiving a winch handle in the form of a short rod 50. The transverse opening 46 in the winch drum 13 is larger in diameter that the transverse opening 47 in the inner cylindrical member 15. The thickness of the rod 50 is such that it is loosely held in the transverse openings 46 and 47. Thus, to retain the rod 50 in the openings 46 and 47, knobs 54 are provided on the ends thereof, at least one of the knobs 54 being separately formed with a threaded projection 55 by which it engages a threaded opening on one end of the rod.

To provide the transverse openings 46 and 47 on winch drum 13 and cylindrical member 15, respectively, an opening of the size of opening 47 is first machined through the ends of the winch drum 13 and the cylindrical member 15 while the winch is mounted on support 30 with its helical spring 20 expanded against the inner wall 36 of the brake cylinder 35, i.e., while the winch 10 is in its braking position. The cylindrical member 15 is then removed from the winch drum 13 and the transverse opening in the winch drum 13 is enlarged to form the transverse opening 46. Thus, when the cylindrical member 15 is again assembled on the winch drum 13 and the assembly including spring 20 is mounted on support 30, the transverse openings 46 and 47 will be concentrically aligned as shown in FIG. 1 and FIG. 4, while the winch is in its brake position. The rod 50 is then inserted in the aligning transverse openings 46 and 47 on the ends of brake drum 13 and member 15, respectively.

Having described the structure of the winch 10 together with its spring brake structure formed by the helical spring 20 disposed within the brake cylinder 35, the manner of operating the winch by use of rod 50 so as to either take up or pay out the cable 40 from the winch drum 13 will next be described in connection with FIGS. 6 to 9, inclusive.

First to be noted in connection with FIGS. 4 and 5 is that when the winch 10 is assembled with the helical spring 20 on the end portion of its cylindrical member 15 within the braking cylinder 35, the winch drum is in its quiescent or normal position. In this position, the winch drum is prevented from rotating in a counterclock direction in its journals on the support 30 because of the frictional force of the helical spring on the inner wall 36 of the brake cylinder 35. As illustrated in FIG. 5, when the winch 10 is thus in its brake position, the lower end 24 of spring 20 resides in the oversized opening 25 on the lower end of cylindrical member 15 in a position close to but spaced from side 26 of opening 25.

Figure 6:
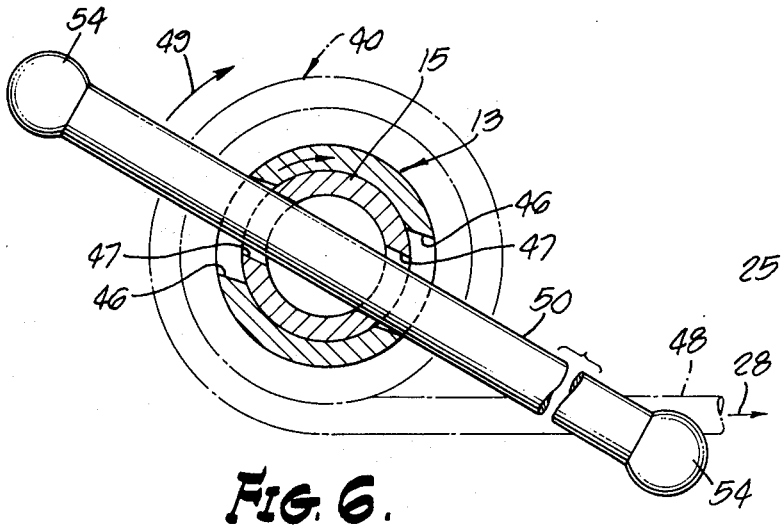
FIG. 6 is a cross-sectional view similar to FIG. 4 showing the rod being provided with a turning action in a clockwise direction which enables the winch drum to be rotated to take up the cable.

The operation of the winch to either take up or pay out the cable 40 with a load on the end thereof can be controlled by the operator applying a turning action on the rod 50 by use of one hand. Thus, as shown in FIG. 6, if it is desired to take up the cable 40 on the winch drum 13, i.e., to rotate the winch drum 13 so as to wind up the cable 40 thereon, the operator need merely use one hand to apply a turning action in a clockwise direction on the rod 50 when viewed from the top of the winch. Such a turning action on the rod 50 in the direction indicated by arrow 49 initially causes the winch drum 13 and, therefore, the upper end 22 of the helical spring 20 to be rotated relative to the lower end 24 of the spring which is located in the oversized opening 25 in the lower end of the cylindrical member 15, so as to wind up, i.e., contract the spring. This initial action of tightening the spring 20 causes a relatively easy turning action thereafter of the spring 20 inside the brake cylinder 35 so that the combined winch drum 13 and cylindrical member 15 can rotate together as a unit on the support 30 to take up the cable 40.

Figure 7:
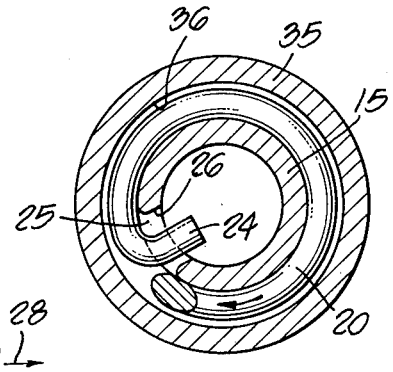
FIG. 7 is a cross-sectional view similar to FIG. 5 showing the position assumed by the oversized opening on the lower end of the cylindrical member relative to the lower end of the spring when the winch drum is being rotated as shown in FIG. 6 to take up the cable.

Note that in order for the side of the rod 50 to contact the side of the transverse opening 46 on the winch drum 13 to rotate the latter, the inner cylindrical member 15 must be free to initially rotate with the rod 50 but without forcing the lower end 24 of the spring to also rotate. The oversized opening 25 on the cylindrical member 15 assures that such action can take place by permitting the member 15 to be rotated a few degrees without contacting the lower end of the spring. This relation of the lower end 24 of the spring to the oversized opening 25 on member 15 when a clockwise turning action is applied on the rod is illustrated in FIG. 7. Thus, as the inner cylindrical member 15 rotates a few degrees clockwise, as a result of the clockwise turning action on rod 50, the lower end 24 of the spring is merely repositioned from side 26 toward the other side of the oversized opening 25. FIG. 7 also illustrates spring 20 being contracted as a result of the clockwise turning action of the rod in FIG. 6 such that the coils thereof are free of the inner wall 36 of the brake cylinder 35.

It should be noted that the turning force required on the rod 50 to contract the spring 20 is only a small fraction of the locking force provided by the spring against the inner wall 36 of the brake cylinder 35. Thus the winch drum 13 with its cylindrical member 15 is able to rotate as a unit on its journals on the support 30 as the operator continues to apply a clockwise turning action to the rod 50 and thereby the winch drum 13 to take up the cable 40. It should be noted that the instant the clockwise turning action on the rod 50 is removed, the helical spring again expands such that its coils again bear against the inner wall 36 of the brake cylinder 35 and prevent the winch drum 13 from counterclockwise rotation.

Now then, when it is desired to pay out the cable 40 from the winch drum 13, the operation is likewise under control of the operator. In this case, however, as shown in FIG. 8, the operator provides for applying a turning action on the rod 50 in a counterclockwise direction when viewed from the top of the winch. Thus, as shown in FIG. 8, the applying of a turning action on the rod 50 in the direction indicated by the arrow 49 initially results in the rod 50 bearing against the sides of the transverse opening 47 on the cylindrical member 15 and causes the cylindrical member 15 to be rotated a few degrees relative to the winch drum 13.

The relation of the lower end 24 of the spring to the oversized opening 25 on the cylidrical member 15 when a counterclockwise turning action is applied on rod 50 is illustrated in FIG. 9. Thus in this case the side 26 of the oversized opening 25 contacts the lower end 24 of the spring 20 and causes it to rotate relative to the upper end 22 thereof so as to contract the helical spring 20. This enables the winch drum 13 and its cylindrical member 15 to rotate together thereafter as a unit to pay out the cable 40.

It should now be clearly understood, that a counterclockwise rotation of rod 50, similar to the clockwise rotation thereof, as discussed above in connection with FIGS. 6 and 7, causes the outer diameter of the coils of helical spring 20 to be initially reduced, i.e., causes the helical spring 20 to be contracted. This enables the spring 20 and therefore the winch 13 to be freely rotated in the journals provided on the support 30 as the operator continues to apply by use of his one hand a turning action on rod 50, and therefore, the winch drum 13 to pay out the cable 40. It should be noted that, as with the operation described in connection with FIGS. 6 and 7, the instant the counterclockwise turning action on the rod 50 is removed the helical spring 20 again expands (see FIG. 5) and bears against the inner surface 36 of the brake cylinder 35 to prevent the winch drum 13 from any further rotation relative to the support 30.

While the description has been concerned with a particularly illustrative embodiment of the present invention it will be appreciated that many modifications and variations in the construction and arrangement thereof can be provided for without departing from the spirit and scope of the invention or sacrificing any of its advantages and the invention is therefore limited only as indicated by the scope of the appended claims.

What is claimed is:

1. A winch comprising:

a tubular winch drum having a cable wound thereon, a cylindrical member rotatably mounted within said winch drum, a helical spring on an end portion of the cylindrical member, said helical spring having one end thereof coupled to rotate with the winch drum and the other end thereof coupled to rotate with the cylindrical member, a support means for said winch drum including a brake cylinder, said helical spring normally having an outer diameter larger than the inner diameter of said brake cylinder, whereby when said winch drum is journaled on said support means with the helical spring on the end portion of the cylindrical member inserted in said brake cylinder the torsional force of the spring bearing against the inner wall of said brake cylinder prevents said winch from rotating on said support means to pay out said cable, and means effective upon applying a turning action on said winch drum and cylidrical member in one angular direction to contract said spring and thereby enable said winch drum to rotate on said support means to take up the cable, and upon applying a turning action on said winch drum and cylindrical member in the opposite angular direction to contract said spring and thereby enable said winch drum to rotate on said support means to pay out the cable.

2. The invention in accordance with claim 1 wherein said helical spring has one end thereof anchored to said winch drum and has the other end thereof loosely residing in an opening in said cylindrical member.

3. The invention in accordance with claim 1 wherein said means includes transverse holes on said winch drum and said cylindrical member, the transverse hole on said winch drum being larger in diameter than the transverse hole on said cylindrical member, and a rod loosely held in said transverse holes for applying the turning action on said winch drum and cylindrical member in either angular direction.

4. A spring locking structure comprising:

a tubular member, a cylindrical member rotatably mounted within said tubular member, a helical spring mounted on an end portion of said cylindrical member, said helical spring having its ends respectively coupled to rotate with said tubular member and said cylindrical member, a support means including a locking cylinder, the inner diameter of said locking cylinder being smaller than the normal outer diameter of said helical spring whereby when said tubular member is journaled on said support means with the helical spring inserted in said locking cylinder the torsional force of the spring causes the outer surface of the coils of the spring to bear against the inner wall of said cylinder to prevent said tubular member from rotating on said support means, and means effective upon rotating said tubular member and said cylindrical member in either angular direction to initially contract said helical spring and thereby free said tubular member and said cylindrical member to rotate as a unit on said support means.

5. The invention in accordance with claim 4 wherein said means is initially effective upon rotating in one direction to rotate said tubular member to apply force on one end of the spring to contract said spring and upon rotating in the other angular direction to rotate said cylindrical member to apply force on the other end of the spring to contract said spring.

* * * * *